US010957185B2

(12) United States Patent
Krstanovic et al.

(10) Patent No.: US 10,957,185 B2
(45) Date of Patent: Mar. 23, 2021

(54) METHOD AND SYSTEM FOR WILDFIRE DETECTION AND MANAGEMENT

(71) Applicant: Sentry Systems, Inc., Windham, NH (US)

(72) Inventors: Christopher S. Krstanovic, Spencer, NC (US); Nicholas Toussi, Windham, NH (US)

(73) Assignee: Sentry Systems, Inc., Windham, NH (US)

( * ) Notice: Subject to any disclaimer, the term of this patent is extended or adjusted under 35 U.S.C. 154(b) by 0 days.

(21) Appl. No.: 16/748,715

(22) Filed: Jan. 21, 2020

(65) Prior Publication Data

US 2020/0242916 A1 Jul. 30, 2020

Related U.S. Application Data

(60) Provisional application No. 62/796,308, filed on Jan. 24, 2019.

(51) Int. Cl.
*G08B 25/10* (2006.01)
*G08B 17/107* (2006.01)
(Continued)

(52) U.S. Cl.
CPC ..... *G08B 25/10* (2013.01); *A62C 3/0271* (2013.01); *G08B 17/005* (2013.01); *G08B 17/107* (2013.01)

(58) Field of Classification Search
CPC combination set(s) only.
See application file for complete search history.

(56) References Cited

U.S. PATENT DOCUMENTS 7,915,829 B2 3/2011 Keller et al.
7,969,296 B1 6/2011 Steil
(Continued)

OTHER PUBLICATIONS

Forest Supervisor—Early Wildfire Detection System.https://www.LADsensors.com; retrieved Apr. 11, 2020.
(Continued)

*Primary Examiner* — Thomas S McCormack
(74) *Attorney, Agent, or Firm* — Rauschenbach Patent Law Group, LLC; Kurt Rauschenbach

(57) ABSTRACT

A remote fire detection system includes a plurality of sensor nodes, each comprising a smoke sensor, a temperature sensor, a gas sensor, and a processor having inputs coupled to the outputs of the sensors. The processor processes the sensor signals to generate at least one of smoke, temperature, or gas metric information, and determines a unique time window within a reporting period. A transmitter transmits report generated by the processor during the unique time window within the reporting period. A personnel node includes a location processor that generates location information of the personnel node and a transmitter that transmits the location information. A gateway node includes a receiver that receives reports generated by the plurality of sensor nodes during the unique time window within the reporting period. A processor generates a waveform comprising synchronization pulses during the reporting period and processing the received reports generated by the plurality of sensor nodes to generate an uplink message in response to the at least some of the sensor metric information. A transmitter transmits the waveform and the uplink message. A server node receives the uplink message and determines a probability of a fire at a location based on sensor metric information of the received uplink message.

49 Claims, 10 Drawing Sheets

(51) Int. Cl.
*G08B 17/00* (2006.01)
*A62C 3/02* (2006.01)

(56) References Cited

U.S. PATENT DOCUMENTS

| | | | | |
|---|---|---|---|---|
| 2006/0176169 | A1 | 8/2006 | Doolin et al. | |
| 2016/0127878 | A1* | 5/2016 | Clarke | H04W 4/021 705/324 |
| 2017/0039828 | A1* | 2/2017 | McAllister | H04B 7/04 |
| 2017/0323389 | A1* | 11/2017 | Vavrasek | H04L 63/1425 |
| 2018/0141518 | A1 | 5/2018 | Iverson et al. | |
| 2019/0108739 | A1* | 4/2019 | Wedig | G08B 29/186 |

OTHER PUBLICATIONS https://www.wildfirewatch.com; retrieved Apr. 11, 2020.
https://www.taoglas.com; retrieved Apr. 11, 2020.

* cited by examiner

METHOD AND SYSTEM FOR WILDFIRE DETECTION AND MANAGEMENT

CROSS REFERENCE TO RELATED APPLICATION

The present application is a non-provisional of U.S. Provisional Application Ser. No. 62/796,308, entitled "Method and System for Wildfire Detection and Management", filed on Jan. 24, 2019. U.S. Provisional Application Ser. No. 62/796,308 is incorporated herein by reference.

INTRODUCTION

Wildfires pose major risks to people, property and a wide variety of biological ecosystems. Wildfires can increase the likelihood of floods and erosion. Wildfires can lead to poor water and air quality and loss of wildlife habitats. Costs associated with wildfires are increasing as are the number of wildfires and their severity in terms of loss of life and property. There is a demand for automated distributed monitoring systems that can be deployed in particular areas and provide data and processed command and control functions to support a variety wildfire risk mitigation activities.

BRIEF DESCRIPTION OF THE DRAWINGS

The present teaching, in accordance with preferred and exemplary embodiments, together with further advantages thereof, is more particularly described in the following detailed description, taken in conjunction with the accompanying drawings. The skilled person in the art will understand that the drawings, described below, are for illustration purposes only. The drawings are not necessarily to scale, emphasis instead generally being placed upon illustrating principles of the teaching. The drawings are not intended to limit the scope of the Applicant's teaching in any way.

DESCRIPTION OF VARIOUS EMBODIMENTS

Figure 1:
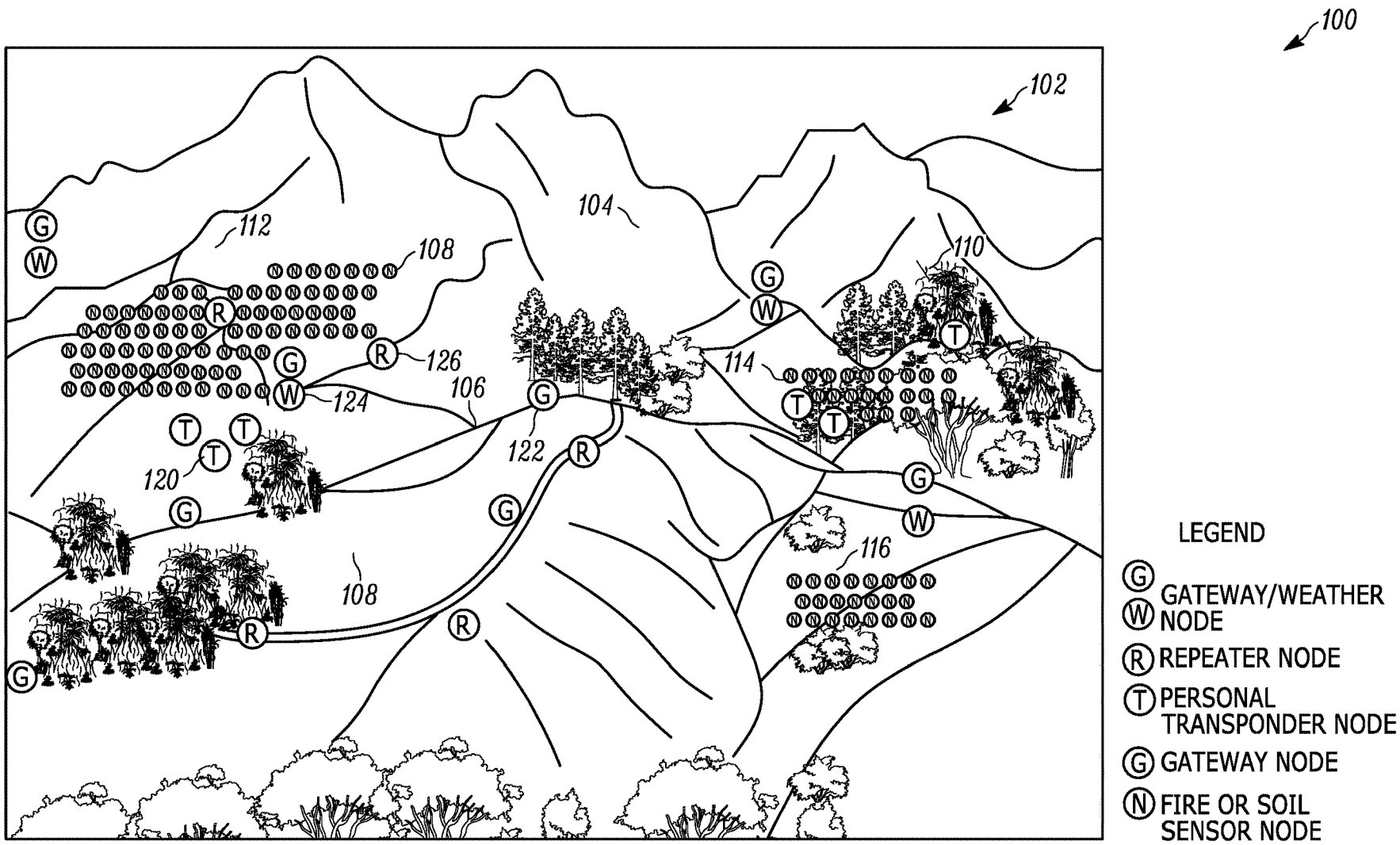
FIG. 1 illustrates an embodiment of a deployed system and method for wildfire detection of the present teaching.

The present teaching will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications and equivalents, as will be appreciated by those of skill in the art. Those of ordinary skill in the art having access to the teaching herein will recognize additional implementations, modifications, and embodiments, as well as other fields of use, which are within the scope of the present disclosure as described herein.

Reference in the specification to "one embodiment" or "an embodiment" means that a particular feature, structure, or characteristic described in connection with the embodiment is included in at least one embodiment of the teaching. The appearances of the phrase "in one embodiment" in various places in the specification are not necessarily all referring to the same embodiment.

It should be understood that the individual steps of the methods of the present teachings can be performed in any order and/or simultaneously as long as the teaching remains operable. Furthermore, it should be understood that the apparatus and methods of the present teachings can include any number or all of the described embodiments as long as the teaching remains operable.

One feature of the system and method for wildfire detection and management of the present teaching is the ability to support wildfire mitigation with command and control oversight functions. It should be understood that wildfire management is an important aspect of the present teaching. The systems and methods of the present teaching can operate at some or all of multiple phases of a wildfire cycle, including pre-fire stage, early-fire stage, fire-fighting stage, and post-fire stage. Some examples are described herein.

In the pre-fire stage, systems and methods according to the present teaching provide dense measurements of regional conditions and sensed parameters. In this way, a fire index can be provided for a specific designated area. In the early-fire stage, which includes early fire detection, systems and methods according to the present teaching detect fire events, providing their precise location and extent. In the fire-fighting stage, systems and methods according to the present teaching monitor the spread of a fire, as well as providing location of firefighting personnel and multiple other asset types. In many embodiments, the system provides data and processed information to command-control users. In a post-fire stage, systems according to the present teaching support ensuring that the fire does not spur up, as well as various after action reports and forensic analysis to support improved fire detection and fighting capabilities going forward.

It should be understood that while systems and methods described herein are associated with wildfire detection, the capability of the systems and methods according to the present teaching is not limited to this application. Systems and methods according to the present teaching can include a variety of sensor systems such as radiation sensors, seismic sensors, multiple axis accelerometers, soil moisture sensors, and numerous other types of sensors. Systems and methods according to the present teaching can also include various detectors such as lightning detectors that detect very low frequency (VLF) and low frequency (LF) range signals resulting from lightning. These additional sensors not only expand the capability for wildfire mitigation, but also expand the particular applications to include, for example, a variety of other disaster mitigation functions for severe weather events, earthquake, and other natural disasters as well as day-to-day regional environmental management tasks. In particular, the ability to provide processed command and control information using cost-effective distributed sensing at fixed locations combined with asset tracking for mobile personnel or other assets is beneficial to these and other applications beyond wildfire risk mitigation.

FIG. 1 illustrates an embodiment of a deployed system and method 100 for wildfire detection of the present teaching. The system is shown deployed over an area to be monitored 102. The area to be monitored 102 may include a variety of terrain, including hills 104, valleys 106, open areas 108 and wooded areas 110. The deployed system and method 100 includes multiple sensor regions 112, 114, 116. Multiple sensor nodes 118 are distributed in these sensor regions 112, 114, 116. In a given area to be monitored, the sensor regions 112, 114, 116 may be contiguous or distinct (as shown). In some embodiments, the shape and size of sensor regions 112, 114, 116 are determined by knowledge of the terrain, topology and/or other features of the region or area to be monitored. In some embodiments, the sensor nodes 118 are deployed in a grid or other regular or irregular pattern. In some embodiments, the sensor nodes 118 are deployed at nominally regular intervals. Sensor nodes 118 including some sensor can be deployed at different intervals. For example, sensor notes with lightning detectors can be deployed at greater intervals. In one specific embodiment, the regular interval is approximately ¼ of a mile. Some specific embodiments distribute sensor nodes 118 at 250 meters to ¼ of a mile apart in a grid configuration. For example, the sensor nodes 118 can include a dedicated fire sensor node and/or a soil sensor node. A variety of sensor nodes are used in the various embodiments of the present teaching. One feature of the present teaching is that the sensor nodes 118 can report their geographical location. This may occur at the time of field provisioning. The geographical location may be based on GPS data. The GPS data may be provided to the node 118 by the installer. The geographical location may also be preset in the sensor nodes 118 based on a location predetermined prior to field provisioning.

The deployed system and method 100 includes personnel nodes 120. The personnel nodes 120 are carried and/or worn by firefighting personnel and other workers. The personnel nodes 120 are used to track and manage firefighting personnel. In some embodiments, the mobile personnel nodes 120 connect to the neighboring network via sensor nodes 118. The personnel nodes 120 operate on battery power and are GPS enabled. The personnel nodes 120 also allow for network triangulation for location identification to augment GPS and/or if no GPS coverage is available. The personnel nodes 120 can include an audio and/or visual user interface. Some embodiments of the personnel nodes 120 provide biometrics via, for example, a 3-axis accelerometer that provides movement detection. Some embodiments of the personnel nodes 120 include additional biometric sensor to sense, for example pulse and body temperature. Biometric measurements allow for an automated alarm trigger based on lack of movement for a predetermined timeframe or can be optionally in response to, for example, body temperature and pulse. These alarm triggers are used to notify command-control. In some embodiments, the personnel nodes 120 are equipped with a personal alarm button. The personnel nodes 120 allow for command-center monitoring of in-field personnel location in near real time via GIS mapping. The personal nodes 120 can be equipped with an optional display to receive command messages that can include both individual messages and group messages.

The deployed system and method 100 includes gateway nodes 122 that are used to coordinate sensor nodes 118 and personnel nodes 120 and to connect to downstream systems that are not shown in FIG. 1. Such downstream systems include, for example, the server 814 described in connection with FIG. 8.

The deployed system and method 100 includes weather station nodes 124 that monitor and report various weather metrics and conditions. Weather station nodes 124 can be radio-enabled. Various types of weather station nodes 124 measure, for example, wind speed and direction, relative humidity (% RH), temperature (° F./° C.), and/or rainfall (in or mm). In some embodiments, a fire-detection node functionality is included in a weather station node 124.

The deployed system and method 100 can optionally include repeater nodes 126 that are used to extend the geographical reach of the various other networks nodes 118, 120, 122, 124. The repeater nodes 126 can, for example, improve wireless line-of-site in mountainous regions and/or compensate for a lack of cellular or other wireless system coverage in a particular area.

In some embodiments, some or all of the sensor nodes 118 are soil moisture nodes. These soil moisture nodes are radio enabled to provide wireless links to other nodes 118, 120, 122, 124, 126. In some embodiments, soil sensor nodes are distributed at regular 1-mile intervals in a grid configuration. These soil sensor nodes report soil moisture content. In some embodiments, soil moisture content is determined by examining the dielectric constant of the soil. Some embodiments use other known soil moisture detection means. Soil moisture nodes report soil moisture content at several soil depths (6", 12", and other depths). The soil moisture content is used to better predict fire index during a pre-fire phase, and give indication of available fire fuel.

In operation, nodes 118, 120, 122, 124 will typically measure their parameters in appropriate time intervals, such as every 10 seconds. The nodes can measure sensed parameters as well as diagnostic information about the components in the sensor or other node. Under stable conditions, nodes 118, 120, 122, 124 only report the latest measurements and a number of diagnostic parameters to the server at relatively long time intervals, such as 10 minute time intervals, as a regularly scheduled check-in. This helps reduce the network traffic, data storage burden and extends battery life. Under pre-determined conditions, or set of rules that are based on both absolute levels and/or increases in certain measured parameters, the sensor nodes 118 will generate on-demand, alert messages to the server. This dynamically increases the node time response, and helps with more rapid processing and monitoring of changed conditions in affected areas within the area being monitored 102. Upon receiving an alert message, the nearby sensor nodes 118 may increase the reporting frequency.

In various embodiments, the various nodes 118, 120, 122, 124, 126 use a variety of battery types to provide power. For example, in some embodiments, personnel nodes 120, gateway nodes 122, weather station nodes 124 and/or repeater nodes 126 use lithium polymer rechargeable batteries. In some embodiments, one or more of these nodes 120, 122, 124, 126 use sealed lead acid batteries, which can alleviate concerns about flammability. In other embodiments, sensor nodes 118 use primary lithium batteries. Lithium batteries have the advantage of high charge density that provides long battery lifetime.

Figure 2:
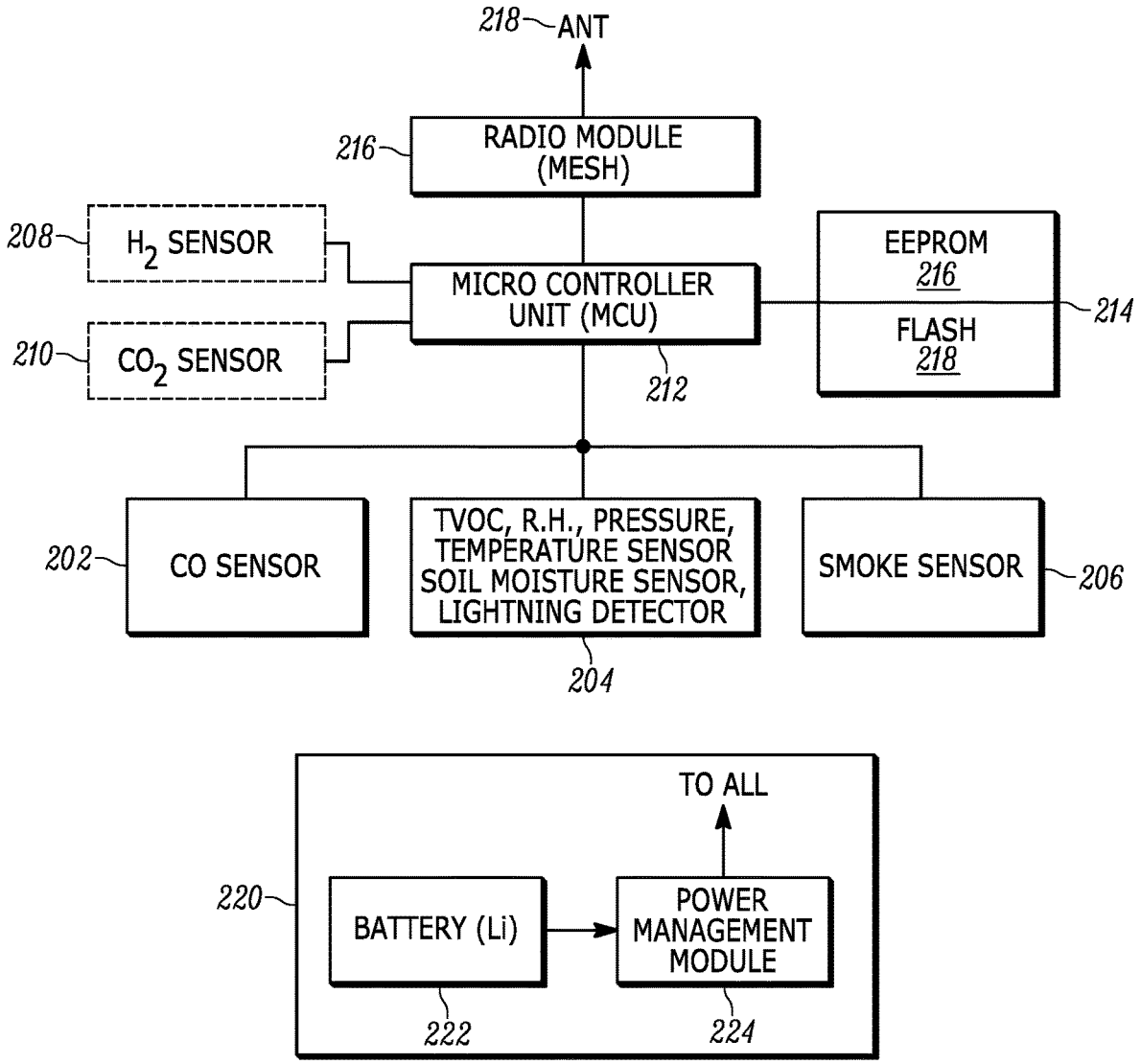
FIG. 2 illustrates a block diagram of an embodiment of a fire detection sensor node of the present teaching.

FIG. 2 illustrates a block diagram of an embodiment of a fire detection sensor node 200 of the present teaching. Referring to the deployed system embodiment of FIG. 1, the fire detection sensor node 200 may comprise one, some or all of the sensor nodes 118 in one, some or all of the sensor regions 112, 114, 116. In this example, the fire detection sensor node 200 includes a CO sensor 202, a total volatile organic compound (TVOC), relative humidity (R.H.), pressure and temperature environmental sensor 204 and a smoke sensor 206. The CO sensor 202 senses non-naturally occurring gases (Carbon Monoxide). The environmental sensor 204 senses relative changes in smoke-related TVOCs such as Ethanol, Acetone, Benzene, Toluene, and measures temperature in degrees Fahrenheit and/or degrees Celsius. In some embodiments, the TVOC measurement from the environmental sensor 204 is used to generate a gas sensor signature signal at an output. That is, if a sensor node 200 detects parameters that indicate an increased risk of "fire", the TVOC sensor in the environmental sensor 204 can operate in a different mode by varying the plate temperature. In this mode, the sensitivity to different gasses varies, and by combining readings at various temperatures, it is possible to get rough gas signature.

The smoke sensor 206 senses smoke constituents, such as smoke particulates (% OBS/ft or % OBS/m). The fire detection sensor node 200 includes an optional $CO_2$ sensor 208 and an optional $H_2$ sensor 210. The various sensors 202, 204, 206, 208, 210 produce respective sensor signals. The various sensors 202, 204, 206, 208, 210 connect to a micro-controller unit (MCU) 212. The MCU 212 includes one or more processors. A memory system 214, that can include electronically erasable programmable read-only memory (EEPROM) 216 and flash memory 218, is connected to the MCU 212.

In various embodiments, the MCU 212 processes various combinations of signals from one or more sensors 202, 204, 206, 208, 210. For example, the MCU 212 processes a signal from the smoke sensor 206. The MCU 212 also processes a signal from a temperature sensor in the environmental sensor 204. The MCU 212 also processes the TVOC signal from the environmental sensor 204. The MCU 212 also processes the relative humidity signal from the R.H. sensor in the environmental sensor 204. The MCU 212 also processes the pressure signal from the pressure sensor in the environmental sensor 204. In addition, the MCU 212 can also process signals from numerous other types of sensors such as a soil moisture sensor and a lightning detector.

The MCU 212 then generates a report based on the processing of any, some or all of the various sensor signals that provides a variety of metric information about the local environment. The metric information includes, for example, the presence or absence of smoke in a local environment, the temperature in a local environment, the presence or absence of particular gases in a local environment, relative humidity in a local environment, temperature in a local environment and/or particular levels or amounts of particular gases in a local environment. In some embodiments, the processing of the sensor signals produce smoke, temperature, and/or gas metric information.

The MCU 212 is connected to a radio module 216 that provides a signal to a wireless antenna 218. The radio module 216 utilizes a radio communication stack that allows for message routing to and from the sensor node 200. In various embodiments, the routing may be to or from another sensor node, a personnel node or a gateway node. In some embodiments, the radio module 216 includes a processor that executes a protocol that is used to synchronize the sensor node to the network. As described herein, this protocol may include determining a unique time window within a reporting period.

The sensor nodes 200 are battery powered. A power unit 220 includes a battery 222 and a power management unit 224. The power management unit 224 is connected to all of the other modules 202, 204, 206, 208, 210, 212, 214, 216, 218, to the extent they need to be powered. In some embodiments, the battery 222 is a lithium battery.

Figure 3:
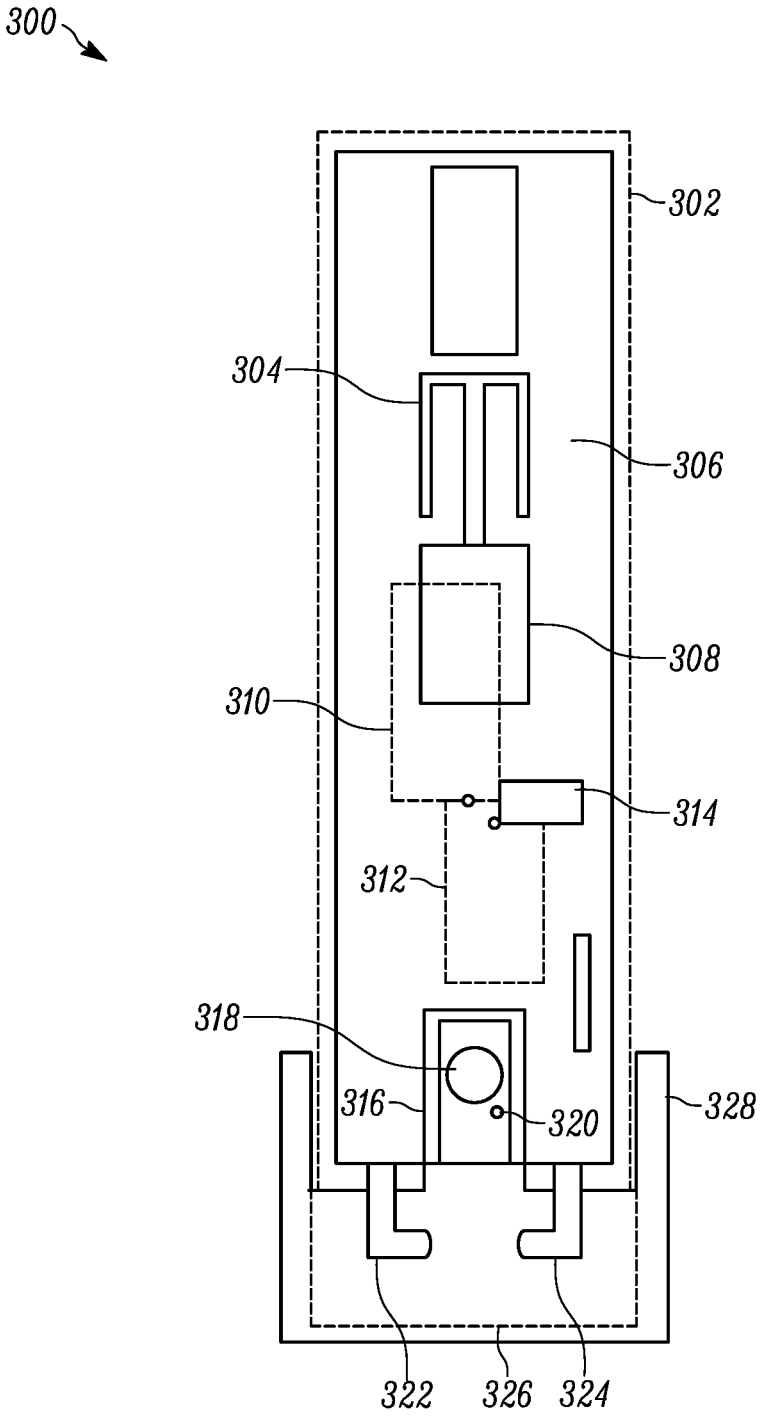
FIG. 3 illustrates a schematic diagram of an embodiment of a sensor node of the present teaching in an enclosure.

FIG. 3 illustrates a schematic diagram of an embodiment of a sensor node 300 of the present teaching in an enclosure. One feature of the sensor node 300 design is that is supports a long lifetime, even when deployed in rugged and/or remote terrain. The enclosure includes a tubular upper section 302 that can be formed of a variety of plastic materials. For example the plastic material may be any one of ultra-violet resistant acrylonitrile styrene acrylate plastic (UV resistant ASA), a blend of acrylonitrile styrene acrylate and polycarbonate (ASA/PC), polycarbonate (PC), polyvinyl chloride pipe (PVC), or other.

Regarding the color of the enclosure, in many implementations the enclosure is white or an IR reflective color that minimizes its temperature rise when exposed to sun light. Temperature rises due to environmental conditions and due to internal heating will lead to shorter battery life and lower reliability. White enclosures are also relatively easy to locate so technicians can more quickly perform maintenance operations. In some implementations, stealth characteristics are desirable and in these implementations, the enclosure may be green or camouflage in color. Also, in some implementations including photoelectric smoke sensor, the closure needs to be formed of a black non-reflective material for proper operation. Radioactive smoke sensors do not require black non-reflective material for proper operation, but are generally less effective for detecting particles from wild fire type of smoke.

One feature of the present teaching is that a radio antenna 304 can be a custom antenna that is integrated on an electronic board 306 that also supports and/or connects other elements in the sensor node 300. An advantage of using an antenna 304 that is inside an enclosure is that the antenna 304 is protected from the elements, such as wind and other weather conditions, and brush and tree growth that can damage the antenna 304. The enclosure's tubular upper section 302 can prevent breakage of the antenna 304 from proximate tree branches. A radio module 308 is integrated onto the board 306.

A lithium battery 310 is integrated onto the backside of the board 306 along with a power control module 312. A lithium battery 310 provides a long lifetime power source. In some embodiments, the lithium battery 310 lifetime is approximately ten years, given an expected power demand of the sensor node 300 components. There is an electric double capacitor (ELDC) supercapacitor 314 that is a low leakage type. The ELDC 314 is used to combat increased lithium battery 310 resistance at low temperatures and/or at low charge levels. The ELDC 314 can prevent, for example, a significant voltage from the radio module 308 and antenna 304 during a wireless transmission that draws a high current. Thus, the ELDC 314 ensures more robust and longer lifetime from the battery 310.

A sensor platform 316 that includes a CO sensor 318 and a TVOC, relative humidity, pressure and temperature sensor 320 is integrated onto the board 306. In some embodiments, the CO sensor 318 is an electrochemical type of CO sensor. The use of electrochemical CO sensors reduces power usage and increase sensitivity of the CO measurement. Numerous other CO sensor types may also be used. In this embodiment, the smoke sensor comprises a photodiode 322 and a light emitting diode 324. The light emitting diode 324 can include a 135-degree scattered source that emits light at 860 nm wavelength. A mesh 326, which can be a 0.4 to 0.8 mm metal mesh, can be used for, e.g. insect protection.

The sensor node 300 can also include a soil moisture sensor having a probe that penetrates into the soil to measure moisture at single or multiple depths. The soil moisture sensor can be internally connected to the sensor node or can be external and independent with wireless communication to the sensor node.

Figure 4:
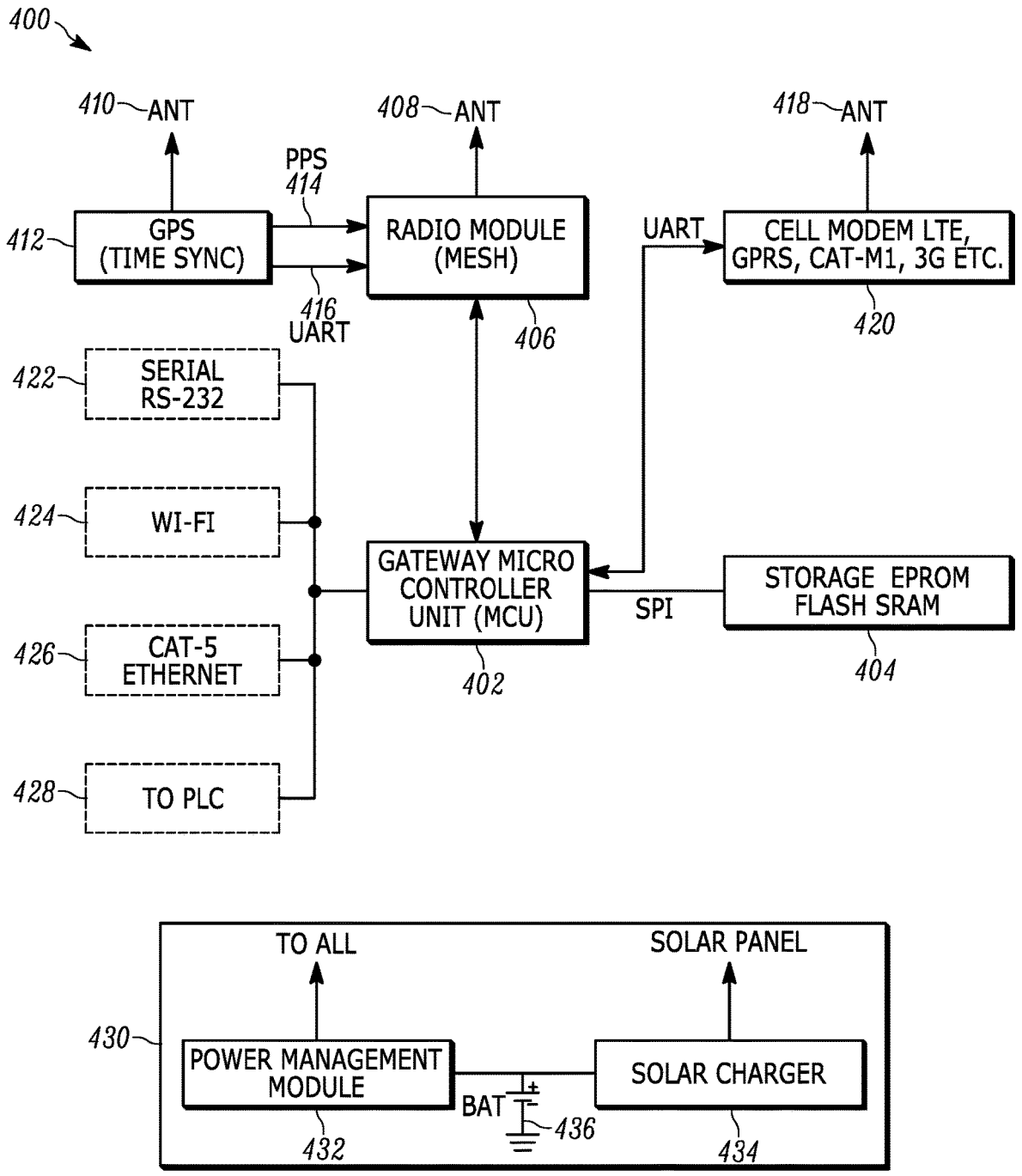
FIG. 4 illustrates a block diagram of an embodiment of a gateway node of the present teaching.

FIG. 4 illustrates a block diagram of an embodiment of a gateway node 400 of the present teaching. The gateway node 400 includes a micro-controller unit 402 that is connected to a storage system 404. The storage system 404 may include EPROM, flash memory and static random access memory (SRAM).

The MCU 402 is also connected to a radio module 406 that provides a signal to a wireless antenna 408. The radio module 406 utilizes a radio communication stack that allows for message routing to and from the gateway node 400 to other gateway nodes, repeater nodes and or sensor nodes. In some embodiments, the radio module 406 includes a processor that executes a protocol that is used to synchronize the gateway node to the other nodes in the fire detection system. As described herein this protocol may include generating a waveform comprising synchronization pulses during a reporting period and processing received reports generated by the plurality of sensor nodes. The MCU 402 generates an uplink message in response to received reports from sensor nodes. For example, the MCU 402 may generate an uplink message in response to received smoke, temperature, or gas metric information. The radio module 406 is connected to a wireless antenna 408.

A global positioning satellite (GPS) antenna 410 and receiver 412 generate a pulse position signal (PPS) 414 and a universal asynchronous receive/transmit (UART) signal 416 to the radio module 406. An antenna 418 connected to a radio communication protocol processor 420 is connected to the MCU 402. The radio communication protocol processor 420 produces any one of a variety of wireless protocols, for example, cellular, LTE, GPRS, CAT-M1, 3G, 5G, WiFi, NB-IOT or other. The MCU 402 can be provided input control signals to and from a number of physical and/or logical media access controller ports, including serial RS-232 422, WiFi 424, Cat-5 Ethernet 426 and/or other programmable logic controller (PLC) 428. A power unit 430 can include a power management unit 432 that conditions power for the modules in the gateway node 400. A solar charge 434 may be included, that connects to a solar panel. In some embodiments other known means of recharge are used. A battery 436 is used to manage/store power.

In operation, a gateway node 400 is configured as an endpoint coordinator, coupled with a cellular modem, or other means provided by the radio communication protocol processor 420 and antenna 418, to link up to a remote server (not shown). All network messages terminating in a gateway node 400 are collected and uplinked to the server (not shown). Connections to the server are provided by a variety of available communication means including via cellular, WiFi, wired network or satellite link. Gateway nodes 400 are capable of keeping data in internal storage 404 for a predetermined period of time, if uplink connection is unavailable, to ensure zero or limited data loss. Gateway nodes 400 can optionally contain a sensor node such as a fire detection, soil moisture or weather station node.

Figure 5:
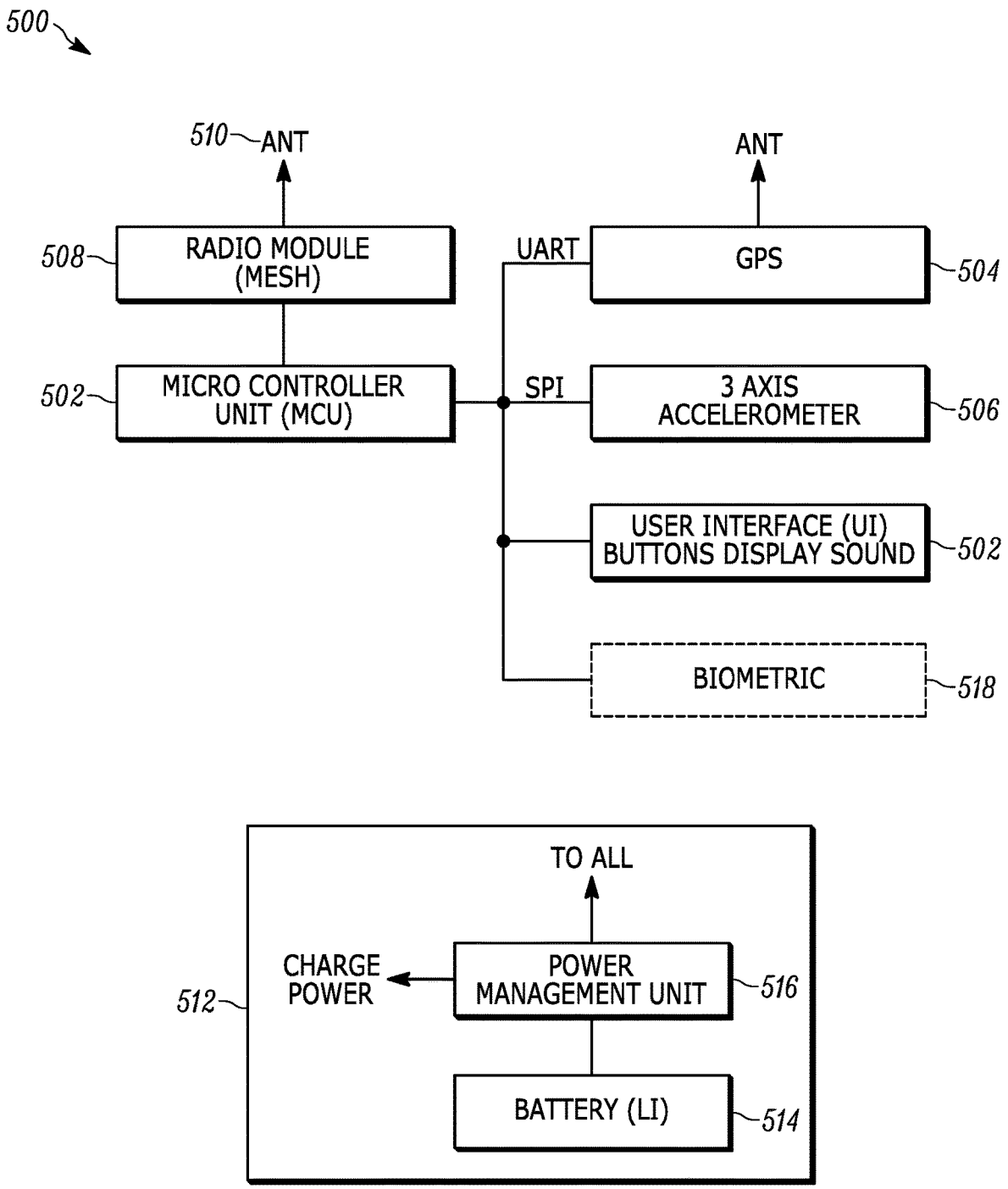
FIG. 5 illustrates a block diagram of an embodiment of a personnel node of the present teaching.

One feature of the present teaching is to provide tracking and managing firefighting personnel locations. FIG. 5 illustrates a block diagram of an embodiment of a personnel node 500 of the present teaching. Personnel nodes 500 are sometimes referred to as tags, or personnel tags. The personnel node 500 includes a MCU 502 that is connected to a GPS 504, a 3-axis accelerometer 506, and a user interface 508. In various embodiments, one or more of the GPS 504, 3-axis accelerometer 506, and user interface 508 are attached or proximate to a person or other asset. The GPS 504 provides location data about the person or asset, and this may be communicated using a UART protocol to the MCU 502. Alternatively, the approximate personnel node 500 location can be derived by location processing in the MCU 502, and/or the server (not shown) based on reported wireless signal strengths received by personnel node 500 from neighboring nodes. For example, the neighboring node may be a gateway node. In one embodiment, the system uses a signal from GPS 504 with fallback to the signal strength method. The MCU 502 location processor is configured to generate location information of the personnel node 500 at an output.

The 3-axis accelerometer 506 provides a variety of motion information about the person, which may be communicated using a standard serial interface (SPI) to the MCU 502. The user interface 508 can include various buttons for the person or asset to input data, displays, to provide information to the person or asset or sound to provide information to the person or asset.

The MCU 502 is also connected to a radio module 508 that provides a signal to a wireless antenna 510. The radio module 508 utilizes a radio communication stack that allows for message routing to and from the personnel node 500. In various embodiments, the routing may be to another personnel node, a sensor node and/or to a gateway node. In some embodiments, the radio module 508 includes a processor that executes a protocol that is used to synchronize the personnel node to the network. As described herein this protocol may include determining a unique time window within a reporting period.

The personnel node 500 is battery powered. A power unit 512 includes a battery 514 and a power management unit 516. The power management unit 516 is connected to all of the other modules in the personnel node 500 to the extent they need to be powered. The battery 514 may be a lithium battery.

In some embodiments, the personnel node 500 includes additional biometric sensors 518 that augment the 3-axis accelerometer 506 that provides motion data. The biometric sensors 518 monitor, for example, temperature, pulse and other parameters to determine the wellbeing of the person or asset. A signal can then be generated to be received by the command if an alert condition is met. Personnel nodes 500 include a user interface 502 so the user can signal the command. The user interface 502 includes a display so emergency messages can be sent to the user. The user interface 502 can include an audio device to alert the user.

Figure 6:
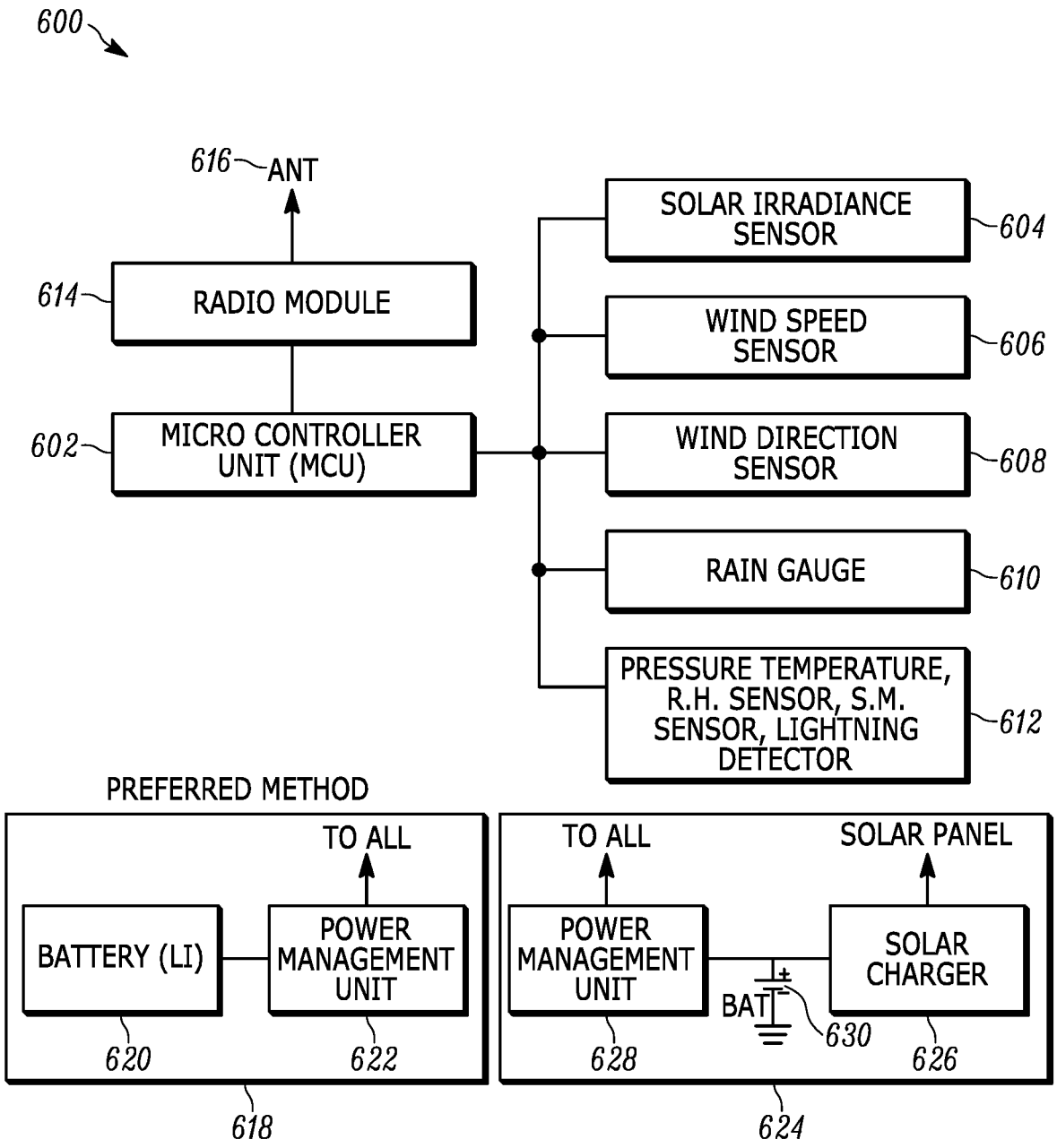
FIG. 6 illustrates a block diagram of an embodiment of a weather station node including soil moisture and lightening sensors and detectors of the present teaching.

FIG. 6 illustrates a block diagram of an embodiment of a weather station node 600 including soil moisture and lightening sensors and detectors of the present teaching. A MCU 602 is connected to a solar irradiance sensor 604, a wind speed sensor 606, a wind direction sensor 608, a rain gauge 610 and a pressure, temperature R.H. sensor 612. In addition, the MCU 602 can be connected to numerous other types of sensors, such as a soil moisture sensor and a lightning detector. Some embodiments of the weather station node 600 may include fewer sensors.

In operation, the weather station nodes 600 are sparsely distributed. The weather station node 600 reports fire-related parameters and weather metrics, such as wind velocity and direction, temperature, RH, soil moisture, and rain quantity. In addition, the weather station node 600 can report on lightning strike events so that data from nodes reporting lightning strikes can be used to estimate if lightning strikes have occurred on the ground and their approximate location by triangulating the position from data generated by multiple nodes or by using various estimation algorithms. These parameters are used for pre-fire analysis to better calculate the area index with higher spatial resolution. These parameters are used during fire condition to better predict fire spread, and protect firefighting personnel.

The MCU 602 is also connected to a radio module 614 that provides a signal to a wireless antenna 614. The radio module 614 utilizes a radio communication stack that allows for message routing to and from the weather station node 600. In various embodiments, the routing may be to another weather node, a personnel node, a sensor node and/or a gateway node. In some embodiments, the radio module 614 includes a processor that executes a protocol that is used to synchronize the weather station node to the network. As described herein this protocol may include determining a unique time window within a reporting period.

The weather station node 600 is battery powered. In some embodiments, a power unit 618 includes a battery 620 and a power management unit 622. The power management unit 622 is connected to all of the other modules in the weather station node 600 to the extent they need to be powered. The battery 620 may be a lithium polymer rechargeable battery. In some embodiments a different power unit includes a solar power unit 624 that includes a power management unit 628 that conditions power for the modules in the weather station node 600. A solar charger 626 connects to a solar panel. A battery 630 is used to manage/store power.

Figure 7:
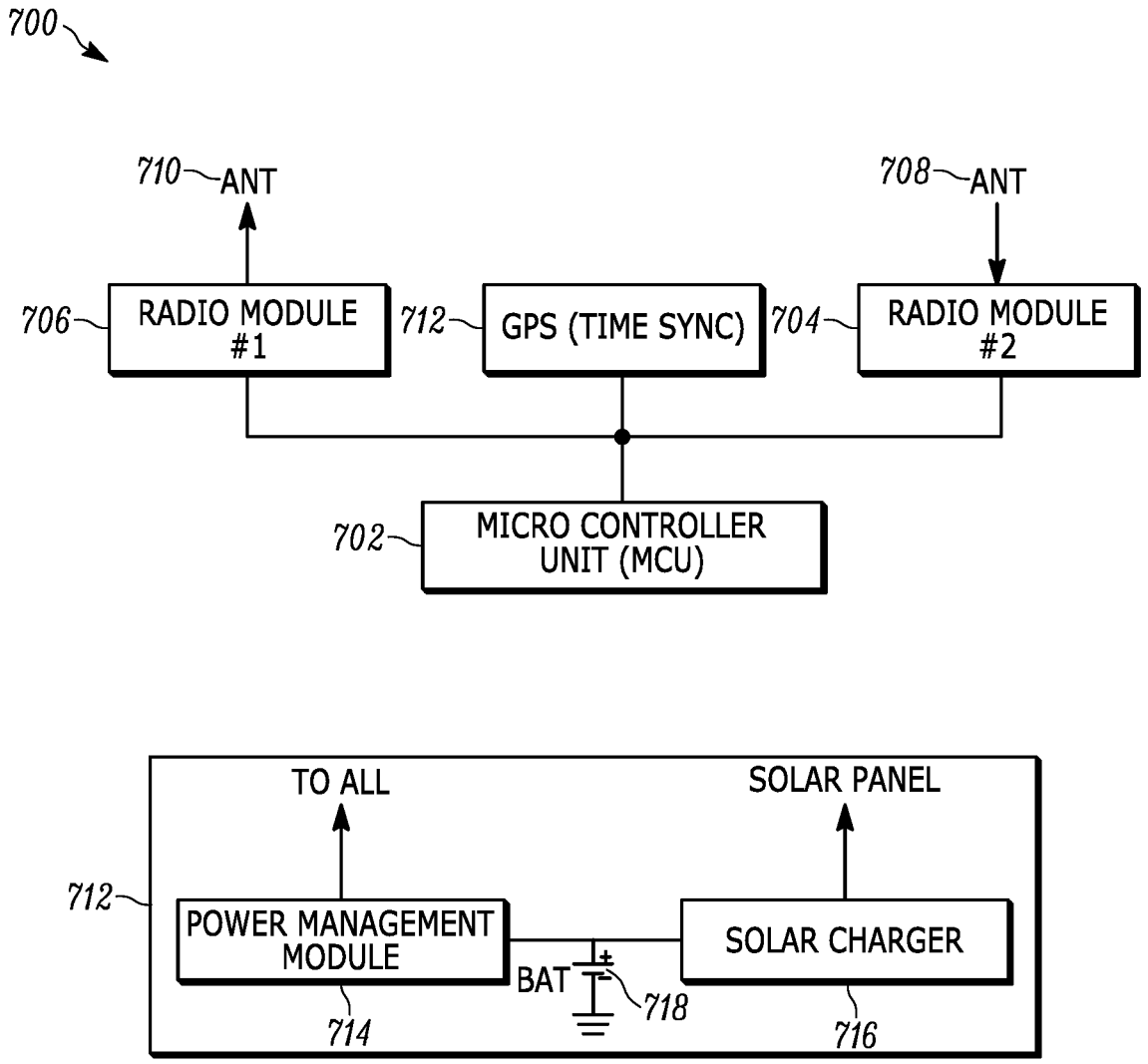
FIG. 7 illustrates a block diagram of an embodiment of a repeater node of the present teaching.

FIG. 7 illustrates a block diagram of an embodiment of a repeater node 700 of the present teaching. A MCU 702 gets input from two radio modules 704, 706. One radio module 704 is connected to an antenna 708 that sends and receives wireless signals from the nodes in the system, and one radio module 706 is connected to another antenna 710 that sends and receives wireless signals to the nodes in the system. The first antenna 708 may operate at one frequency, while the second antenna 710 operates at a different frequency. There is a GPS module 712 that connects to the MCU 702. The repeater node 700 may also connect a gateway to a server. In some embodiments, one radio in the node, for example radio module 704 and antenna 708, allows sensor connectivity and management. The other radio in the node, for example radio module 706 and antenna 710, is used to merge stream message data towards the gateway. In this embodiment, the first radio module 704 and antenna 708 may support sensor node data collection, just like in the gateway node described in connection with FIG. 4, using MCU 702. The second radio module 706 and antenna 710 listens for other repeaters (on a different frequency). The second radio module 706 and antenna 710 forwards the data from the other repeaters, as well as that collected by the first radio module 704 and antenna 708. All the processing can be managed by the MCU 702. Thus, the repeater node 700 supports operation very similar to the gateway node described in connection with FIG. 4, except that it also allows other repeaters to send their data.

The repeater nodes 700 can be powered by a variety of power sources, including locally generated power. In some embodiments, a power unit 712 includes a power management unit 714 that conditions power for the modules requiring power in the repeater node 700. A solar charger 716 connects to a solar panel. A battery 718 is used to manage/store power.

In operation, a repeater node 700 contains endpoint node functionality like a gateway node and forwards radio messages toward the gateway nodes either directly or indirectly through other repeater nodes. A repeater node 700 provides a high-speed, backbone link to a gateway node. A repeater node 700 may be utilized in case of (cellular) uplink coverage unavailability in certain areas. The use of a repeater node 700 can minimize the number of message hops in large spanning installations, i.e. a large number of nodes. A repeater node 700 may be advantageously placed on elevated terrain to improve range. Range can exceed 10 miles. In some embodiments, the repeater node 700 may provide a range extension of between 1 mile and 30 miles.

One feature of the present teaching is that the various nodes can connect and self-configure a network using wireless communication links into a networked system. The networked system utilizes a radio communication protocol that requires minimal power, thus allowing the nodes, including the sensor nodes and the personnel nodes, to use only a small amount of power. This feature allows those nodes to operate on battery power.

Figure 8:
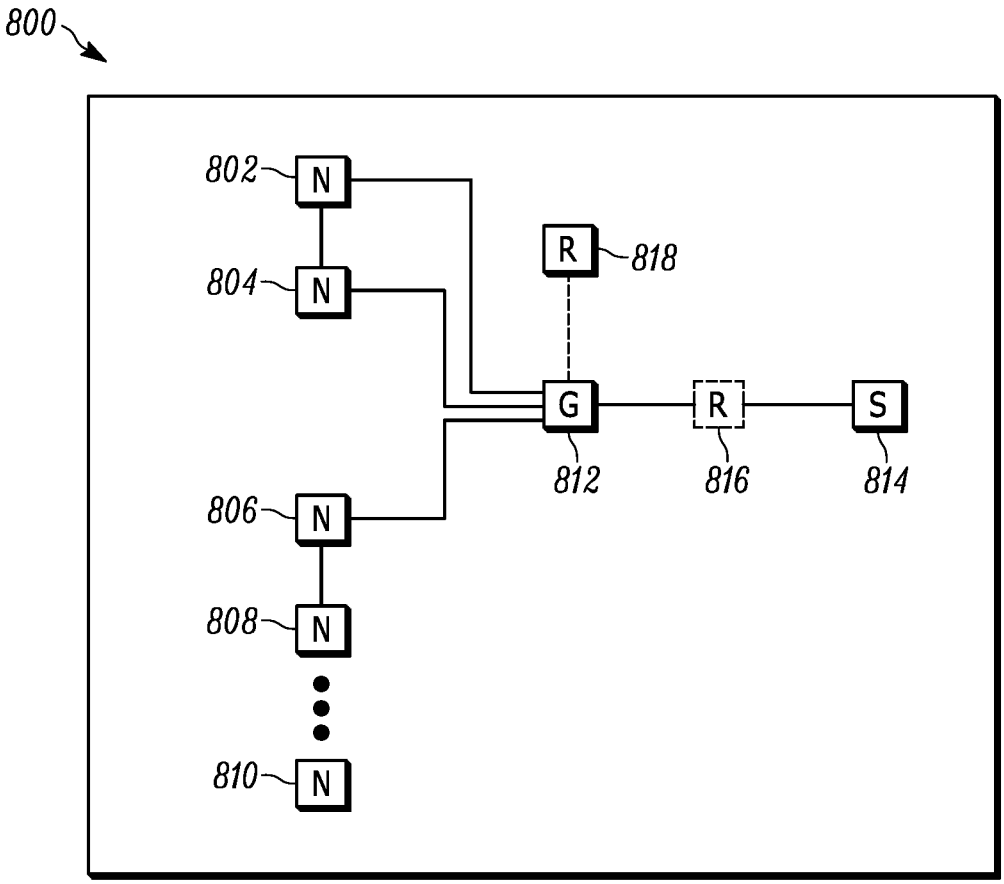
FIG. 8 illustrates a block diagram of an embodiment of networked system for fire detection of the present teaching.

FIG. 8 illustrates a block diagram of an embodiment of networked system for fire detection 800 of the present teaching. Multiple sensor nodes 802, 804, 806, 808, 810 are located at particular locations within a sensor region. The sensor nodes 802, 804, 806, 808, 810 power-up and connect to nodes within their wireless range using wireless links. In various embodiments, different network connectivity is established. For example, sensor nodes 802, 804 may connect to each other and also to a gateway node 812. A sensor node 806 may connect to a gateway node 812 and to another sensor node 808 that is unable to connect to the gateway node 812. A large number of sensor nodes 810 are envisioned that can connect to each other and/or to one or more gateway nodes 812, depending on various factors. The gateway node 812 can connect to a server 814, either directly or via an optional repeater node 816. Any given gateway node 812 can connect to one or more optional repeater nodes 818.

The server 814 includes listeners that receive information forwarded from one or more gateway nodes 812. In some embodiments the server 814 includes a cloud-based database. The server 814 includes a central data processor, and a secure user interface. The server 814 can include one or more servers that are co-located and/or distributed.

In operation, the server 814 provides data storage, data processing, data analytics and user interface (UI) processing devices. The server 814 accepts all data streams that contain reports from sensor nodes, gateways, repeaters and personnel nodes. The message streams that contain reports are used to monitor the health of the system and to provide desired measurements and functional parameters of a monitored area in near real time. Based on the data in the reports, a propensity toward fire events or risk of fire events can be calculated as well as probability of a fire in progress and its location.

In case of fire, it is possible to monitor the precise location of fire as well as location of firefighters on the ground. Based on multiple parameter measurements, it is possible to warn the personnel on the scene to evacuate an area. In some embodiments, firefighters have access to internet via cellular or similar communication services. Firefighters can then access the server so they will have access to full situational awareness.

In some embodiments, the server 814 executes a fire detection algorithm. The primary purpose of the algorithm is to provide the probability that fire has occurred in a specific area. To minimize false positives, multiple and mutually exclusive parameters are measured and monitored by the algorithm. Examples of primary parameters can include measurement of carbon monoxide and smoke that do not naturally exist. Examples of considered scenarios include a photo-electric smoke sensor that will detect fog as possible smoke. In particular, with high relative humidity, the absence of carbon monoxide and/or no rise TVOCs, it can be confidently determined that the smoke sensor is detecting fog and not smoke from a fire. Alternatively, detection of smoke coupled with presence of carbon monoxide and/or rise in TVOCs would present a high likelihood of fire being present. A high likelihood of fire being present can be further substantiated when multiple sensors within a cluster or group report similar changes. Additionally, it must be noted that electro-chemical sensors are typically susceptible to temperature induced baseline drift of several parts per million (PPM) throughout the day, as well as slow, long term drifts, precluding very low level absolute triggers. But the normal rate of change is very slow (less than 0.02 PPM per minute), so if a substantial change is detected, this allows for early detection of a fire condition. Thus, by dynamically monitoring these changes within the sensor nodes, it can be determined if substantial and alarming carbon monoxide or TVOC level change has occurred. This change, along with other measured parameters can be used to generate an exception indicating presence of fire.

The purpose of the user interface (UI) in the server 814 is to allow visual monitoring and analysis of conditions and reported data from the field by central monitoring personnel. The primary UI will be presented in the form of a GIS (Geographic Information System) type map either running exclusively as an independent application or in a secure web page via a central server processor and displayed on any of a variety of known displays. The map can show clusters of active sectors or an entire monitored area. The operator can zoom in/out with ease to view large a scale installation or an individual node. Near real-time and location tracking of personnel nodes can be displayed dynamically on the map.

In case of a possible fire, the nodes that are represented graphically on the map can trigger a color change, accompanied with additional warning indicators. Because the server processor calculates the per node fire event probability, it is possible to show this in form of a heat map, or a 3D plot, for easy visualization of the situation. Each sensor node can be individually examined by an operator for current measurement data, data history in graph or tabular form, and diagnostic information. Further analytics can be added to allow warnings for specific areas of possible hazards or a fire likelihood under certain conditions through predictive analysis. Specifically, color codes, heat maps, and/or 3D plots can be used to display those conditions with various granularity to indicate potential for fire. In some embodiments, the server 814 processes various readings from a plurality of nodes to create an area fire probability map that provides a fire probability at various locations within the monitored area.

One feature of the present teaching is the recognition that it is equally important to suppress false positive indications of fire or other hazards, as it is to detect the fire or other hazards. The fire probability calculation is based on mutually supporting metrics and mutually excluding metrics. That is, for example, simultaneously increases of mutually supporting smoke and CO metrics will indicate an increase in the probability of a fire condition. Also, mutually excluding smoke and high RH mean fog is an indication a low probability of a fire condition. Also, a very high smoke and no corresponding gas rises is an indication of a low probability of a fire condition. The fire probability in any given location can be determined by an analysis of clustering of higher-than-normal readings in neighboring nodes.

The server 814 can provide additional features that benefit users even outside of monitoring activity. For example, a training and simulation module provides a simulated fire event to be used for training and exercise for purposes of in-field, support and administrative personnel training. Additionally, the system can be used to simulate fire events for analysis and modeling of response to the event. Forensic analysis is supported by live and historical data that can be used to view event history in both tabular, and graphic form with time stamped interval for post fire forensic investigation. This can aid in better understanding root cause of certain events by examining conditions before, during and after an event in a time lapsed environment.

One feature of the systems according to the present teaching is that the various nodes form a communication networked system 800 that connects the nodes 802, 804, 806, 808, 810 to a server 814 that may reside in a command center. The communication network and associated communication protocols and antennas have several features that are critical to operation of the wildfire detection system and method of the present teaching. In various embodiments, the protocol is designed to require very little battery usage in the sensor nodes. Also, in various embodiments, the protocol is designed to increase the likelihood that sensor data from any given sensor node is received at the server. Also, in various embodiments, the protocol is designed to operate wirelessly and include service in regions that do not have access to other public or private communication means (e.g. wired networks, cellular networks, etc.). However, the communication protocol is capable of operating with the public or private means if and as available. Also, in various embodiments, the protocol is designed to provide speedy access to sensor data in a real time or near-real time basis. Also, in various embodiments, the protocol is designed to provide high reliability and robustness to failure or non-availability of nodes. As stated, the protocol is capable of leveraging existing standard communication protocols, but goes beyond the capabilities of, for example, a typical standard wireless standard for sensors, such as XBee, ZigBee, Bluetooth and/or GPRS.

Figure 9:
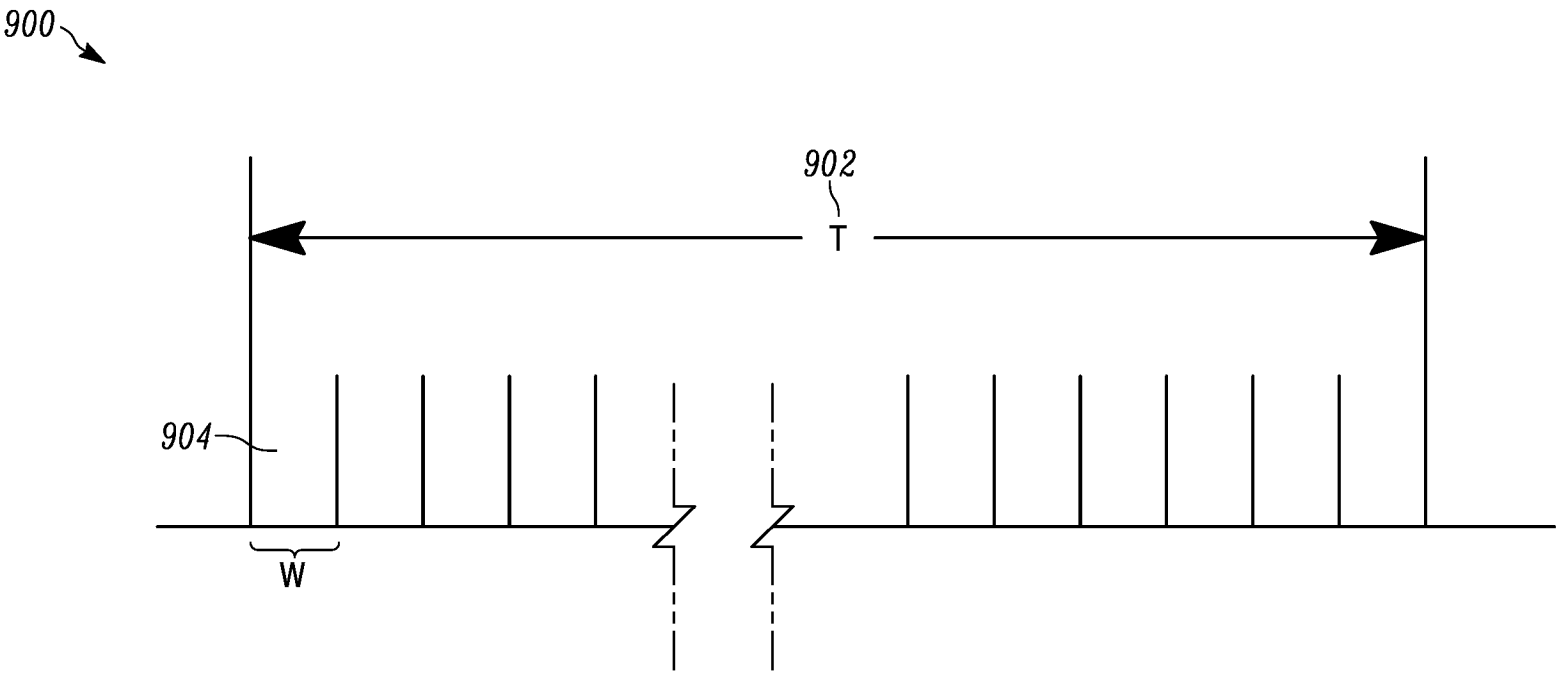
FIG. 9 illustrates an embodiment of a timing sequence for network synchronization of the wildfire detection system of the present teaching.

FIG. 9 illustrates an embodiment of a timing sequence 900 for network synchronization of the wildfire detection system of the present teaching. The timing sequence includes a reporting period 902, T. The reporting period T 902 is in one particular exemplary embodiment ten minutes. The reporting period is typically made up of equal-duration time windows 904. The time windows 904 in one particular exemplary embodiment is 10-second duration. Thus, in this particular embodiment, there are 60 time windows 904 in a reporting period.

In some embodiments, each sensor node in a deployed system is provided a unique particular time window out of the plurality of time windows 904 in a reporting period 902. The node sends data in the form of a report transmitted during the unique time window towards a gateway node. The sensor nodes synchronize to the timing sequence 900 based on synchronization pulses that are sent by the gateway node during the reporting period. Thus, in some embodiments, the sensor nodes generate an internal clock based on the reporting period 902. In some embodiments, sensor nodes that are farther from the gateway may transmit reports that are forwarded by sensor nodes that are closer to the gateway. As such, the unique time windows for further nodes are assigned at the beginning of the reporting period, and sensor nodes that are closer to the gateway are assigned unique time widows that are at the end of a reporting period. In the example given, sensors generate reportable data every 10 seconds, and under stable conditions, report data in a unique 10-second duration window every ten minutes. However, the nodes are also capable of increasing frequency of reporting. These high-frequency reports can be sent in another time window within a same reporting period 902, or can be sent asynchronously.

One feature of the present teaching is that information from a variety of fixed sensors that are distributed over a region can be processed to determine the probability of a fire at a particular location. This processing provides data to command and control facility at various stages of a wildfire that can indicate a high-reliability of probable fire conditions and a low probability of false alarm. These data can be provided in real time and or in a historical presentation.

Figure 10:
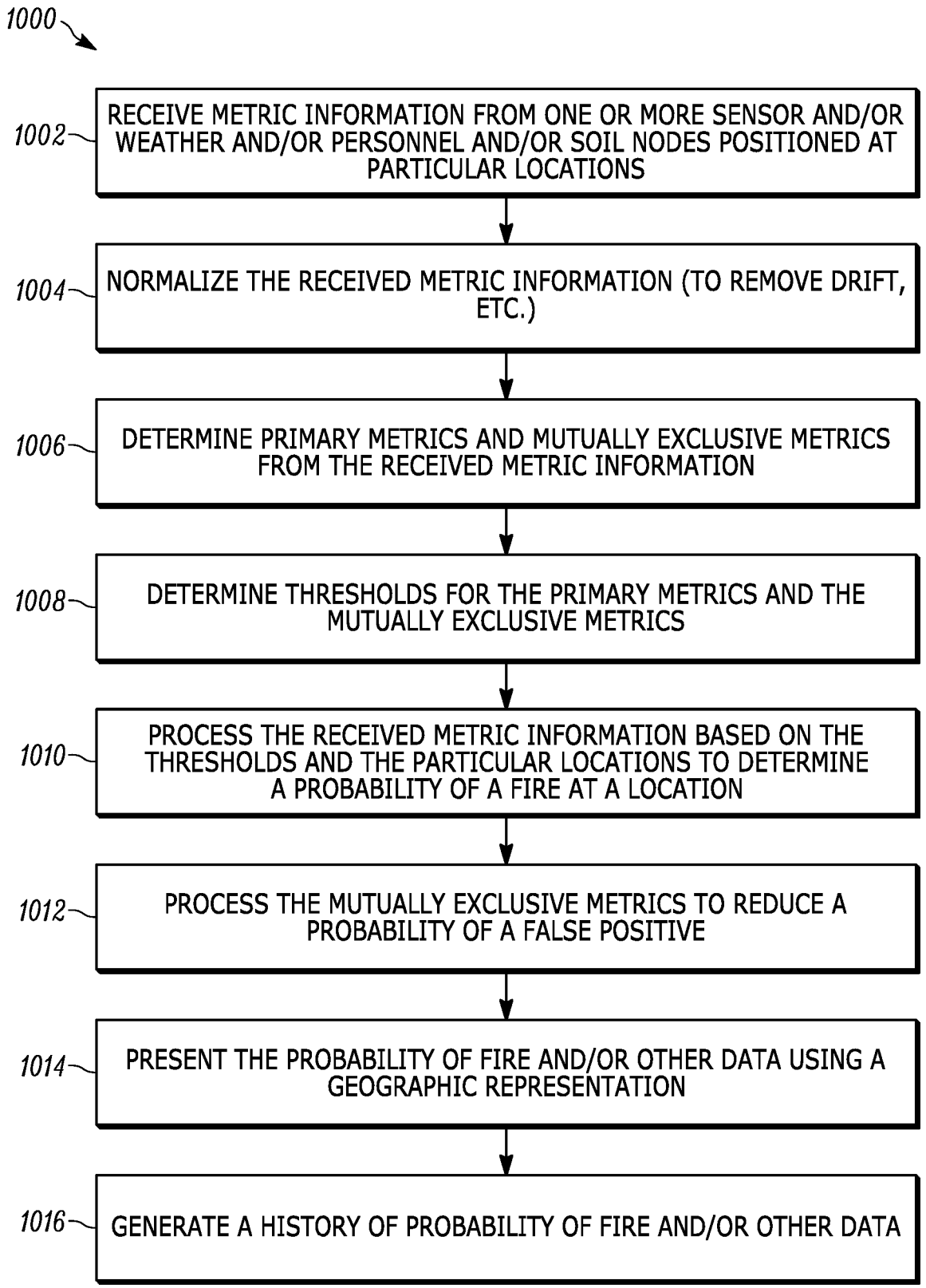
FIG. 10 illustrates steps in an embodiment of a method for wildfire detection of the present teaching.

FIG. 10 illustrates steps in an embodiment of a method for wildfire detection 1000 of the present teaching. In step one 1002, metric information is received from one or more sensor and/or weather and/or personnel and/or soil nodes positioned at particular locations. Referring to FIG. 1, this could be metric information that is provided in reports generated by various nodes 118, 120. Sensor nodes 118 can be either soil moisture nodes or fire detection sensor nodes as described herein. Other metrics may be generated from sensors as understood by those skilled in the art and described herein.

In step two 1004, the received metric information is normalized. The normalization is used to remove drift of components. The normalization may be based on other sensor data and/or known background information including age, and environmental conditions.

In step three 1006, primary metrics are determined and mutually exclusive metrics are determined based on the received metrics. For example, primary metrics are metrics that are known to reliably predict presence of a fire. Mutually exclusive metrics are at least two metrics that each may exhibit high and/or threshold measured parameters for non-fire situations, but will not both mutually exhibit high and/or threshold measured parameters in the same non-fire situation.

In step four 1008, thresholds are determined for the primary metrics and the mutually exclusive metrics. The thresholds are determined, for example, based on known factors, such as external conditions, age of components in the system, requirements based on particular use-cases for the system. These determined thresholds are used in operation to alert sensors to increase a reporting frequency and/or to increase or change sensing parameters. The determined thresholds are also used by the gateways and servers to provide alerts and changes to user interface.

In step five 1010, received metric information is processed based on the thresholds and the locations of the sensor nodes and/or personnel tags and/or weather stations to determine a probability of a fire at a location.

In step six 1012, the mutually exclusive metrics are processed to reduce a probability of false alarm.

In step seven 1014, the results of the processing step five 1010 and step six 1012 are presented at a user interface. This includes correlating the location information to provide a geographic representation of the processed results.

In step eight 1016, a history of data is generated. This history can be used for both real time processing and analysis, as well as in forensic and/or simulation and training applications.

In some embodiments, the steps of the method 1000 are performed in the server. In some embodiments, only some of the steps are performed. In some embodiments, step five 1010 includes calculation of a fire confidence index (FCI). The FCI determines the likelihood of fire happening. Two indexes are calculated, a static index and a dynamic index. The higher index is reported. The static index is based on absolute readings from the sensors, and the thresholds are higher because of sensor drifts. The dynamic calculation looks at relative changes, and calculates a dynamic fire confidence index based on these relative changes. The dynamic index is more sensitive as it eliminates sensor drift, but slower events may not be caught. This is why the static FCI is also calculated. In these embodiments, there may or may not be primary and exclusive metrics used.

In some embodiments, sensor nodes may generate "exceptional" data if any of the predetermined monitoring parameters change more than the predetermined amount. These may be sent in either established transmit window, or outside of these windows, depending on the type of exceptional data that is determined. These reports may be displayed in the server UI and/or be included in the data history, and may or may not be additionally processed using the various steps of the method for wildfire detection 1000.

EQUIVALENTS

While the Applicant's teaching is described in conjunction with various embodiments, it is not intended that the Applicant's teaching be limited to such embodiments. On the contrary, the Applicant's teaching encompass various alternatives, modifications, and equivalents, as will be appreciated by those of skill in the art, which may be made therein without departing from the spirit and scope of the teaching.

What is claimed is:

1. A remote fire detection system comprising:

a) a plurality of sensor nodes, each of the plurality of sensor nodes comprising:
   i) a smoke sensor that generates a smoke sensor signal at an output;
   ii) a temperature sensor that generates a temperature sensor signal at an output;
   iii) a gas sensor that generates a gas sensor signal at an output;
   iv) a processor comprising a first input coupled to the output of the smoke sensor, a second input coupled to the output of the temperature sensor, and a third input coupled to the output of the gas sensor, the processor processing the smoke sensor signal, the temperature sensor signal, and the gas sensor signal to generate at least one of smoke, temperature, or gas metric information, generating a report comprising the at least one of smoke, temperature, or gas metric information, and determining a unique time window within a reporting period; and
   v) a transmitter having an input electrically connected to an output of the processor, the transmitter transmitting the report generated by the processor during the unique time window within the reporting period;

b) a personnel node comprising:
   i) a location processor that generates location information of the personnel node at an output; and
   ii) a transmitter having an input electrically connected to the output of the location processor, the transmitter transmitting the location information of the personnel node;

c) a gateway node comprising:

i) a receiver that receives at least some of the reports generated by the plurality of sensor nodes during the unique time window within the reporting period;

ii) a processor generating a waveform comprising synchronization pulses during the reporting period and processing the received reports generated by the plurality of sensor nodes to generate an uplink message in response to the at least some of the smoke, temperature, or gas metric information of the received reports; and iii) a transmitter that transmits the waveform and the uplink message; and d) a server node that receives the uplink message and determines a probability of a fire at a location based on at least one of the smoke, temperature, or gas metric information of the received uplink message.

2. The remote fire detection system of claim 1 wherein the unique time window within the reporting period determined by a respective one of the plurality of sensors is dependent on an absolute position of the respective one of the plurality of sensors.

3. The remote fire detection system of claim 1 wherein the unique time window within the reporting period determined by a respective one of the plurality of sensors is dependent on a position of a respective one of the plurality of sensors relative to a position of a respective one of another of the plurality of sensors.

4. The remote fire detection system of claim 1 wherein the unique time window within a reporting period determined by a respective one of the plurality of sensors is dependent on a distance from a respective one of the plurality of sensors to the gateway node.

5. The remote fire detection system of claim 4 wherein the unique time window within a reporting period determined by a respective one of the plurality of sensors is proportional to a distance from a respective one of the plurality of sensor to the gateway node.

6. The remote fire detection system of claim 1 wherein the processor in at least one of the plurality of sensors further generates diagnostic information in the unique time window within the reporting period.

7. The remote fire detection system of claim 1 wherein the processor in at least one of the plurality of sensor nodes generates an internal clock signal based on the waveform.

8. The remote fire detection system of claim 1 wherein the processor in at least one of the plurality of sensor nodes generates an internal clock signal based on the reporting period.

9. The remote fire detection system of claim 1 wherein at least one of the plurality of sensor nodes generates at least one of smoke, temperature, or gas metric information from another one of the plurality of sensor nodes.

10. The remote fire detection system of claim 1 wherein the processor in at least one of the plurality of sensor nodes generates an alert when least one of smoke, temperature, or gas metric information indicates an alert threshold has been exceeded.

11. The remote fire detection system of claim 1 wherein the processor in at least one of the plurality of sensors instructs the transmitter to transmit an alert message at a time that is independent of the unique time window.

12. The remote fire detection system of claim 1 wherein the transmitter of the gateway node transmits the uplink message generated by the processor as a cellular message.

13. The remote fire detection system of claim 1 wherein at least one of the plurality of sensor nodes further comprises a global positioning system receiver.

14. The remote fire detection system of claim 1 wherein the gateway further comprises a global positioning system receiver.

15. The remote fire detection system of claim 1 wherein the gateway node and at least one of the plurality of sensor nodes comprise the same node.

16. The remote fire detection system of claim 1 wherein the plurality of sensor nodes are positioned at regular intervals.

17. The remote fire detection system of claim 16 wherein the position of the plurality of sensor nodes at regular intervals forms a grid.

18. The remote fire detection system of claim 16 wherein the regular intervals comprise approximately one-quarter of a mile.

19. The remote fire detection system of claim 1 wherein the smoke sensor comprises a light source and a photodiode.

20. The remote fire detection system of claim 1 wherein the gas sensor comprises a CO sensor.

21. The remote fire detection system of claim 1 wherein at least one of the plurality of sensor nodes further comprises a TVOC sensor.

22. The remote fire detection system of claim 21 wherein the TVOC sensor generates a gas sensor signature signal at an output.

23. The remote fire detection system of claim 1 wherein at least one of the plurality of sensor nodes further comprises a relative humidity sensor.

24. The remote fire detection system of claim 1 wherein at least one of the plurality of sensor nodes further comprises a soil moisture sensor.

25. The remote fire detection system of claim 1 wherein the gateway node further comprises a lightning detector.

26. The remote fire detection system of claim 1 wherein at least one of the plurality of sensor nodes is enclosed in a tubular enclosure.

27. The remote fire detection system of claim 26 wherein a portion of the tubular enclosure comprises a mesh material.

28. The remote fire detection system of claim 1 wherein the server node receives the transmitted location information of the personnel node.

29. The remote fire detection system of claim 28 wherein the server node generates a tracking map of firefighting personnel.

30. The remote fire detection system of claim 1 wherein the location processor processes data from a GPS.

31. The remote fire detection system of claim 1 wherein the location processor processes a received wireless signal.

32. The remote fire detection system of claim 1 wherein the location processor determines a signal strength of a received wireless signal.

33. The remote fire detection system of claim 1 wherein the personnel node further comprises a biometric sensor.

34. The remote fire detection system of claim 1 further comprising a weather station node.

35. A method of detecting a probability of a fire at a remote location, the method comprising:

a) generating at least one of a smoke sensor signal, temperature sensor signal, and gas sensor signal at each of a plurality of sensor nodes;

b) generating at least one of smoke, temperature, or gas metric information from the at least one of a smoke sensor signal, temperature sensor signal, and gas sensor signals at each of the plurality of sensor nodes;

c) generating a report comprising at least some of the smoke, temperature, or gas metric information for each of the plurality of sensor nodes;

d) transmitting the report generated during a unique time window within a reporting period for each of the plurality of sensor nodes;

e) receiving at least some of the reports during the unique time window within the reporting period at a gateway node;

f) generating a waveform comprising synchronization pulses during the reporting period and processing the received reports generated by the plurality of sensor nodes to generate an uplink message in response to the at least some of the smoke, temperature, or gas metric information of the received reports; and g) determining a probability of a fire at a location based on at least one of the smoke, temperature, or gas metric information in the received uplink message.

36. The method of claim 35 wherein the unique time window within the reporting period is dependent on an absolute position of the sensor nodes.

37. The method of claim 35 wherein the unique time window within the reporting period is dependent on a position of a respective one of the plurality of sensor nodes relative to a position of a respective one of another of the plurality of sensor nodes.

38. The method of claim 35 wherein the unique time window within a reporting period is dependent on a distance from a respective one of the plurality of sensor nodes to the gateway node.

39. The method of claim 35 wherein the unique time window within a reporting period is proportional to a distance from a respective one of the plurality of sensor nodes to the gateway node.

40. The method of claim 35 further comprising generating diagnostic information in the unique time window within the reporting period.

41. The method of claim 35 further comprising generating an internal clock signal based on the waveform.

42. The method of claim 35 further comprising generating an internal clock signal based on the reporting period.

43. The method of claim 35 further comprising generating an alert when least one of smoke, temperature, or gas metric information indicates an alert threshold has been exceeded.

44. The method of claim 35 further comprising instructing the transmitter to transmit an alert message at a time that is independent of the unique time window.

45. The method of claim 35 further comprising transmitting the uplink message as a cellular message.

46. The method of claim 35 further comprising receiving global positioning system data for at least some of the plurality of sensor nodes.

47. The method of claim 35 further comprising receiving global positioning system data at the gateway node.

48. The method of claim 35 wherein the plurality of sensor nodes are positioned at regular intervals.

49. The method of claim 48 wherein the position of the plurality of sensor nodes positioned at regular intervals forms a grid.

* * * * *